US008360621B2

(12) United States Patent
Avila et al.

(10) Patent No.: US 8,360,621 B2
(45) Date of Patent: Jan. 29, 2013

(54) LIGHTING FIXTURE HAVING MULTIPLE DEGREES OF ROTATION

(75) Inventors: Henry Avila, Palmdale, CA (US); Elena Kushinskaya, Encino, CA (US)

(73) Assignee: U.S. Pole Company, Inc., Palmdale, CA (US)

( * ) Notice: Subject to any disclaimer, the term of this patent is extended or adjusted under 35 U.S.C. 154(b) by 210 days.

(21) Appl. No.: 12/115,462

(22) Filed: May 5, 2008

(65) Prior Publication Data

US 2009/0040774 A1 Feb. 12, 2009

Related U.S. Application Data

(60) Provisional application No. 60/916,242, filed on May 4, 2007.

(51) Int. Cl.
*F21S 8/08* (2006.01)

(52) U.S. Cl. ..... 362/419; 362/147; 362/275; 362/287; 362/427

(58) Field of Classification Search ..... 362/147, 362/220, 269, 275, 285, 287, 418, 419, 427, 362/432
See application file for complete search history.

(56) References Cited

U.S. PATENT DOCUMENTS

| | | | | |
|---|---|---|---|---|
| 2,029,532 | A * | 2/1936 | Karcher | 403/114 |
| 2,458,967 | A * | 1/1949 | Wiedenhoeft | 248/283.1 |
| D223,547 | S | 5/1972 | Ohwa | |
| D295,287 | S | 4/1988 | Krogsrud et al. | |
| D316,303 | S | 4/1991 | Layne | |
| D316,452 | S | 4/1991 | Kira | |
| D345,518 | S | 3/1994 | Merlo | |
| D350,212 | S | 8/1994 | Yuen | |
| D350,620 | S | 9/1994 | Yuen | |
| D351,678 | S | 10/1994 | Chen | |
| D373,437 | S | 9/1996 | Kira | |
| 5,584,574 | A | 12/1996 | Haddad | |
| 5,599,091 | A | 2/1997 | Kira | |
| 5,713,662 | A | 2/1998 | Kira | |
| D405,903 | S | 2/1999 | Lin | |
| D423,130 | S | 4/2000 | Kung | |
| 6,497,501 | B1 | 12/2002 | Harder | |
| D495,079 | S | 8/2004 | Mullen | |
| D519,662 | S | 4/2006 | Mullen | |
| D544,137 | S | 6/2007 | Montefusco | |
| 2006/0193138 | A1 | 8/2006 | Montefusco | |

FOREIGN PATENT DOCUMENTS

| | | |
|---|---|---|
| DM | 055879 | 3/2001 |
| DM | 055880 | 3/2001 |

* cited by examiner

*Primary Examiner* — Jason Moon Han
(74) *Attorney, Agent, or Firm* — Christie, Parker & Hale, LLP

(57) ABSTRACT

A lighting fixture has a modular design. A plurality of interconnecting components fit together to impart to the lighting fixture multiple degrees of rotation. This enables the installer or user to effectively move, change, or adjust the area of illumination over time without constraints. A lamp housing is supported by a plurality of tubular arms that have a threaded connection at one end and a slip-fit connection at the other end. These connections enable the arms to be rotated independently of each other. The result is a lighting fixture having multiple degrees of rotation. An enclosed path through the tubular arms and a hinge leads from a J-box to the lamp housing. The enclosed path accommodates electrical wiring to power the lighting fixture, while the hinge enables the lamp housing to rotate about an axis parallel to the mounting surface.

12 Claims, 7 Drawing Sheets

LIGHTING FIXTURE HAVING MULTIPLE DEGREES OF ROTATION

CROSS-REFERENCE TO RELATED APPLICATION(S)

This application claims priority to and the benefit of U.S. Provisional Application No. 60/916,242 filed on May 4, 2007, the entire contents of which are incorporated herein by reference. This application also claims priority to U.S. Design application Ser. No. 29/280,765 filed Jun. 6, 2007 entitled Lighting Fixture which is incorporated herein by reference.

BACKGROUND OF THE INVENTION

This invention relates to lighting fixtures and more particularly to a lighting fixture that has multiple degrees of rotation.

There are a number of lighting applications in which it is desirable to move, change, or adjust the area of illumination over time. In other applications it is desirable to use the same lighting fixture design to illuminate areas having different lighting patterns. A single immovable lighting fixture is unsatisfactory in such applications.

SUMMARY OF THE INVENTION

A lighting fixture has a modular design. A plurality of interconnecting components fit together to impart to the lighting fixture multiple degrees of rotation. This enables the installer or user to effectively move, change, or adjust the area of illumination over time without constraints.

According to one feature of the invention, a lamp housing is supported by a plurality of tubular arms that have a threaded connection at one end and a slip-fit connection at the other end. These connections enable the arms to be rotated independently of each other. The result is a lighting fixture having multiple degrees of rotation.

According to another feature of the invention, an enclosed path through the tubular arms and a hinge leads from a J-box to the lamp housing. The enclosed path accommodates electrical wiring to power the lighting fixture, while the hinge enables the lamp housing to rotate about an axis parallel to the mounting surface.

DETAILED DESCRIPTION OF THE INVENTION

Figure 1:
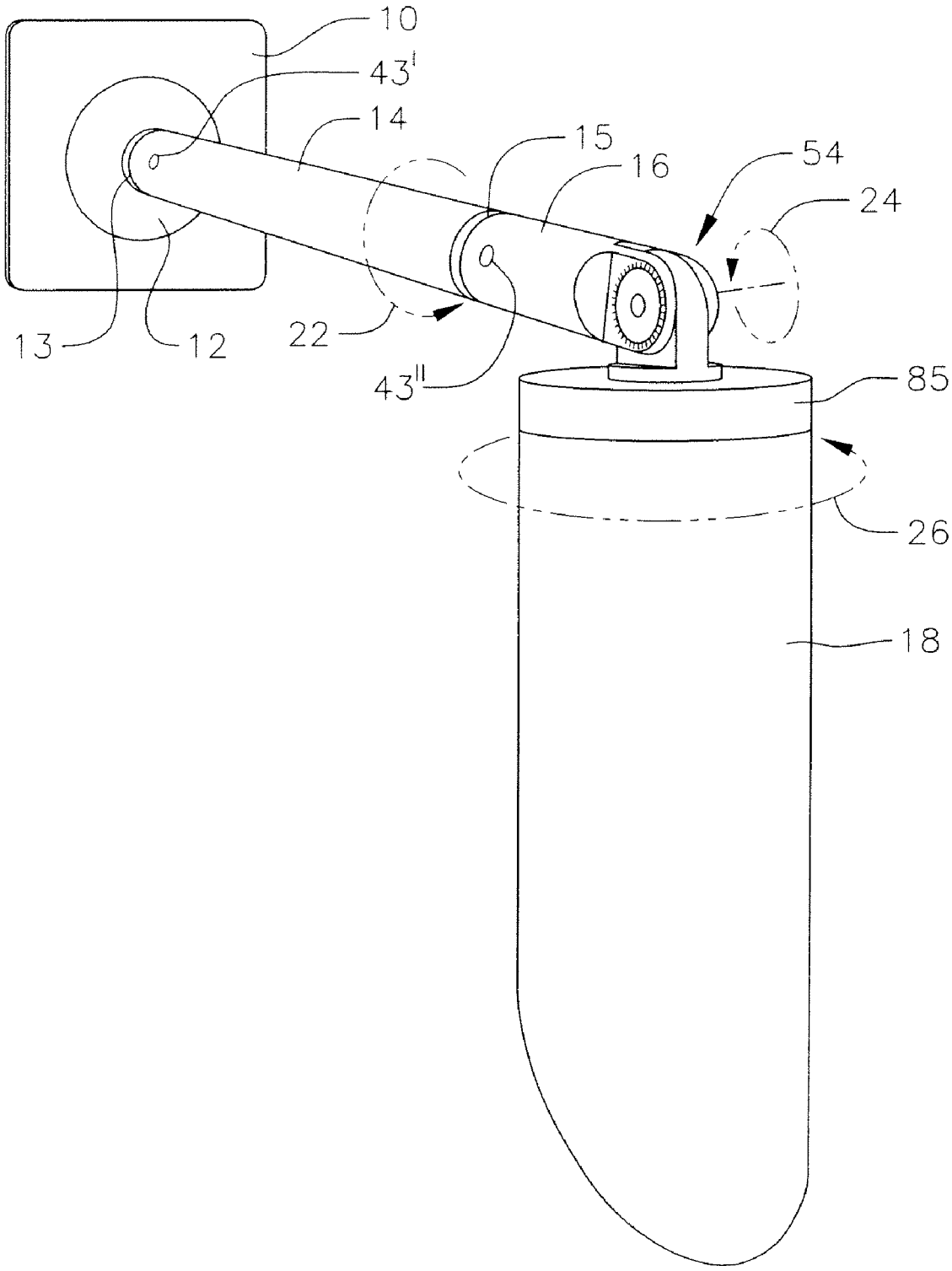
FIG. 1 is a perspective view of one embodiment of a lighting fixture incorporating the invention.
Figure 2:
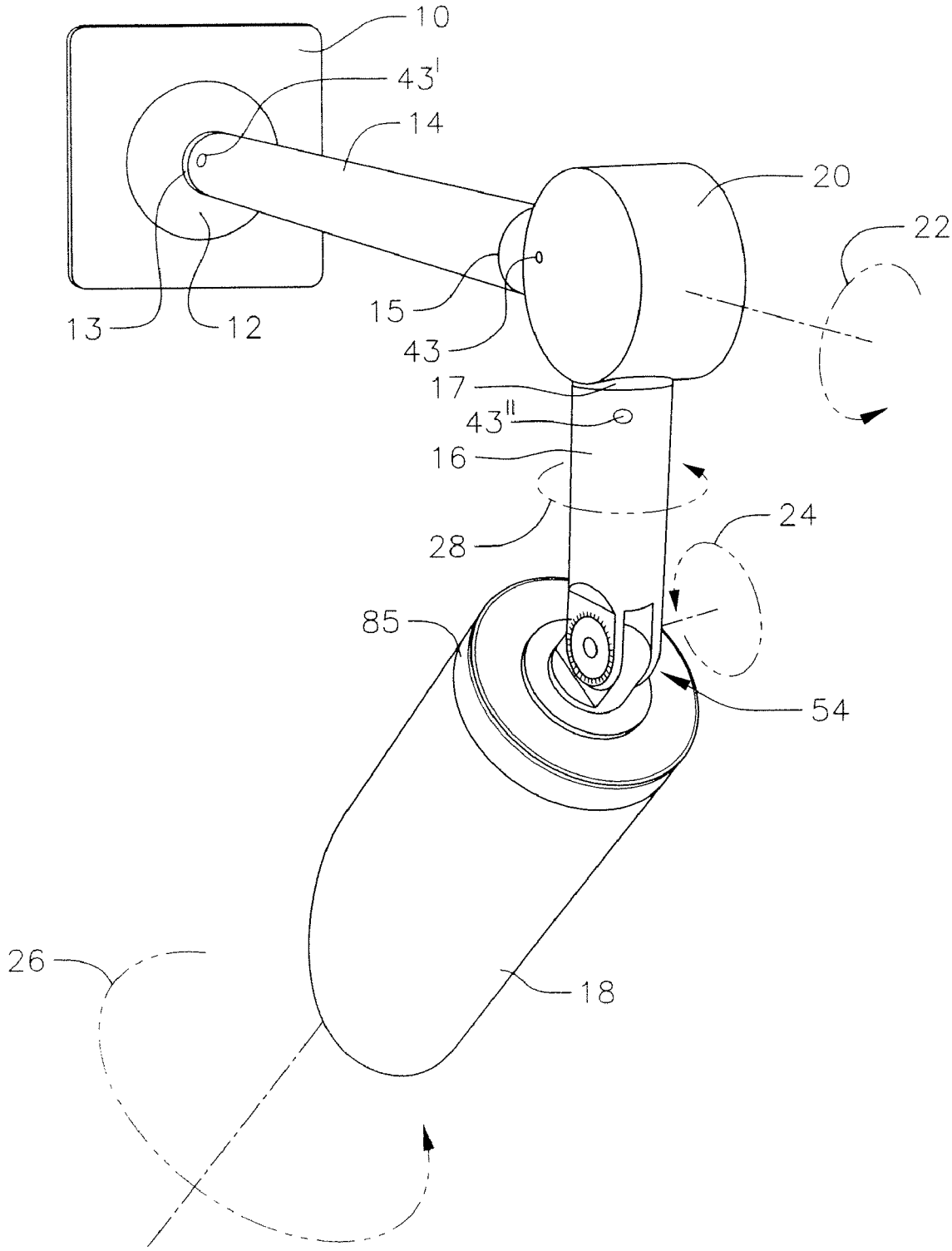
FIG. 2 is a perspective view of another embodiment of a lighting fixture incorporating the invention.

FIGS. 1 and 2 show embodiments of the invention. These embodiments have in common a wall mounted plate 10, a collar 12, a nipple 13, a hollow arm stem 14, a hollow supporting arm 16, and a cylindrical lamp housing 18. Lamp housing 18 can have an oblong edge as shown or a circular edge, depending on the desired shape of the illuminated area. In addition to the mentioned parts, the embodiment of FIG. 2 has a nipple 15, a nipple 17, and a disk-shaped elbow 20 between arm stem 14 and arm 16, which permits lamp housing 18 to illuminate the wall, if desired.

Figure 3:
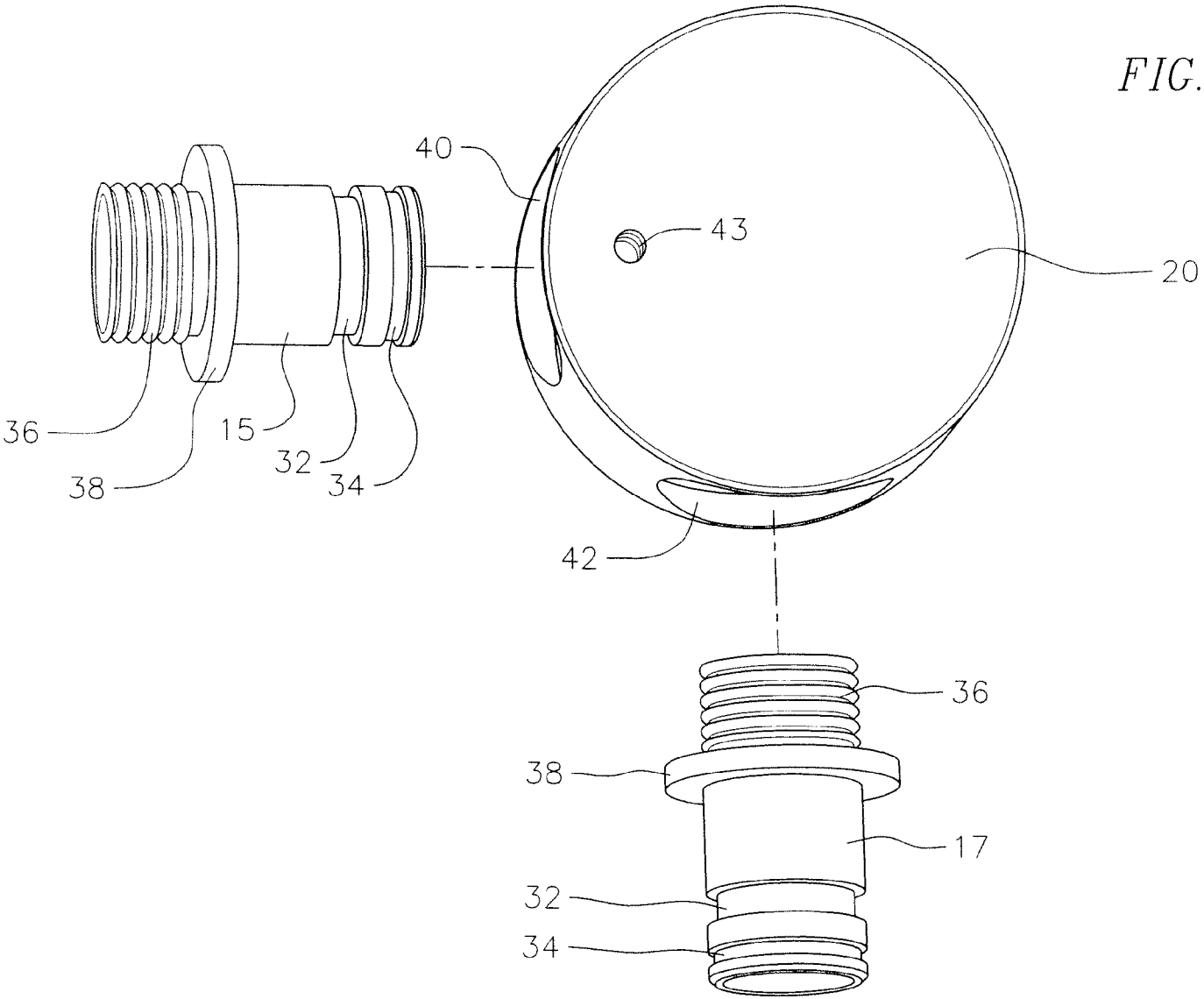
FIG. 3 is a perspective view of one of the components of the embodiment of FIG. 2 viewed from a different perspective to better illustrate the features of the component.

Nipples 13, 15, and 17 each form a threaded connection at one end and a slip-fit connection at the other end as illustrated for nipple 15 in FIG. 3. As shown in FIG. 3, on one end of nipple 15 is formed the slip-fit connection having an O-ring retaining annular groove 32 and a set screw receiving groove 34. The threaded connection is formed on the other end of nipple 15 by threads 36. An annular flange 38, which serves as a washer for the threaded connection, is formed between the end connections.

Nipple 13 forms a threaded connection with a J-box (not shown) behind wall plate 10 and a slip-fit connection with the adjacent end of arm stem 14, which has a smooth bore into which the end of nipple 13 is inserted. A set screw (not shown) passes through a hole 43' in the side of arm stem 14. Nipple 15 forms a threaded connection with the other end of arm stem 14. In the embodiment of FIG. 1, nipple 15 forms a slip-fit connection with arm 16, which has a smooth bore into which nipple 15 is inserted. In the embodiment of FIG. 2, nipple 15 forms a slip-fit connection with bore 40 of elbow 20. In the embodiment of FIG. 2, nipple 17 forms a threaded connection with elbow 20 and a slip-fit connection with arm 16, which has a smooth bore into which nipple 17 is inserted. In both embodiments set screw 52 (shown in FIGS. 4 and 5)) passes through a hole 43" in the side of arm 16.

Elbow 20 (FIGS. 2 and 3) has a smooth bore 40 into which the slip-fit connection end of nipple 15 is inserted and a threaded bore 42 into which the threaded end of nipple 17 is screwed. Bores 40 and 42 are preferably countersunk so flange 38 is flush with the surface of elbow 20. A set screw (not shown) passes through a hole 43 in the side of elbow 20. When the set screw is fully engaged in a first position, it bears against the bottom of groove 34 so nipple 15 cannot be removed from bore 42 and cannot rotate. When set screw is backed off a little to a second position, nipple 15 can rotate but cannot be removed. When the set screw is backed off more to a third position nipple 15 can be removed from elbow 20. (Nipples 13 and 17 are constructed and function in the same way as nipple 15.)

In both embodiments it is possible to adjust the lighting fixture in three rotational directions—namely, about the axis of arm stem 14 as represented by an arrow 22, about an axis perpendicular to arm stem 14 as represented by an arrow 24, and about the axis of lamp housing 18 as represented by an arrow 26. Further, in the embodiment of FIG. 2 it is possible to adjust the lighting fixture in a fourth rotational direction—namely about the axis of arm 16 as represented by an arrow 28.

The rotation represented by arrows 22 and 28 is made possible by the described slip-fit connections. To rotate nipple 13, 15, or 17, the set screw is backed off a small amount to permit the nipple to turn without release from bore 42. After the desired adjustment is made, the set screw is tightened again.

It should be noted that arm stem 14, arm 16, and nipples 13, 15, and 17 are interchangeable in the embodiments of FIGS. 1 and 2.

Figure 4:
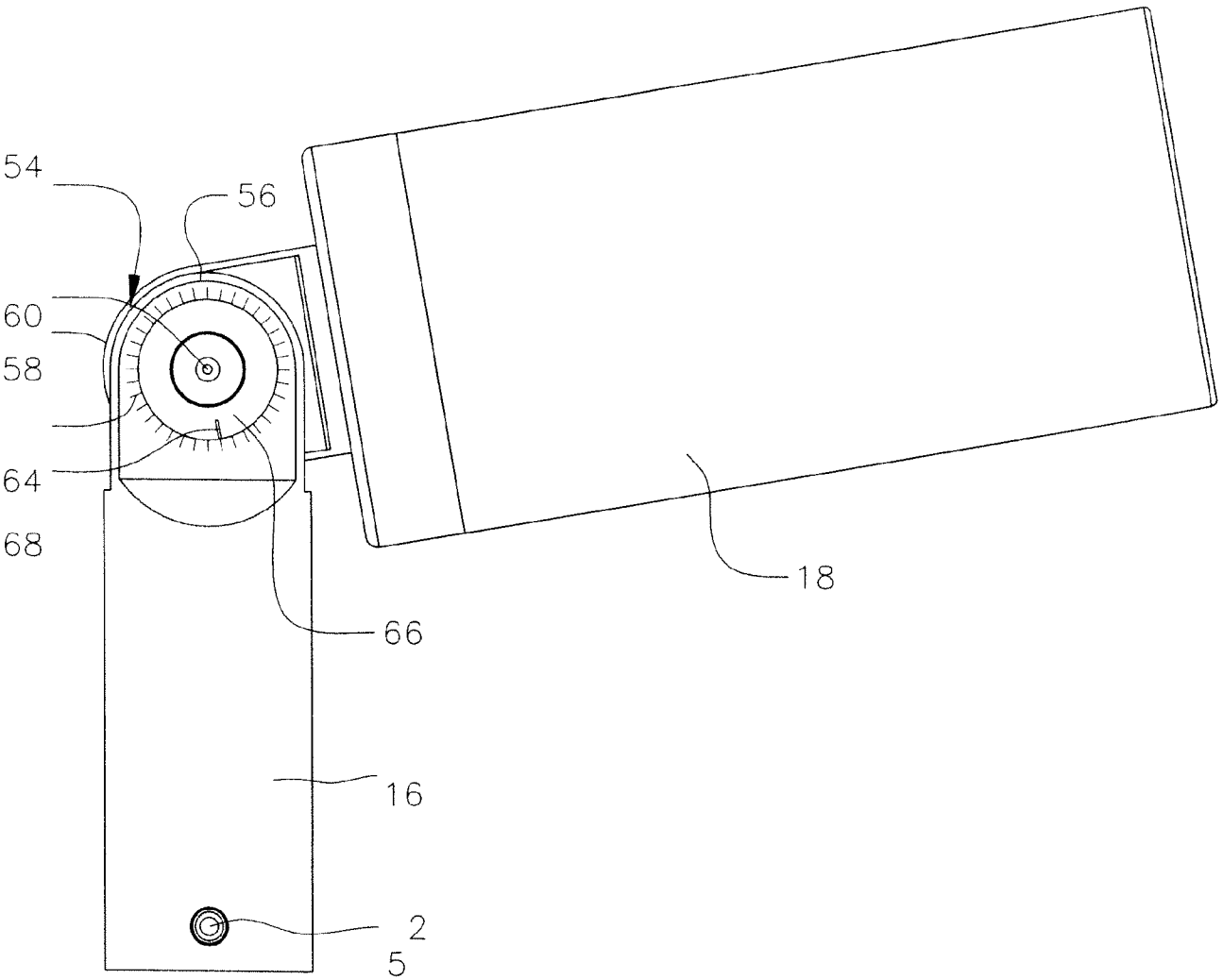
FIG. 4 is a side plan view of the lamp housing and a supporting arm of the lighting fixture.
Figure 5:
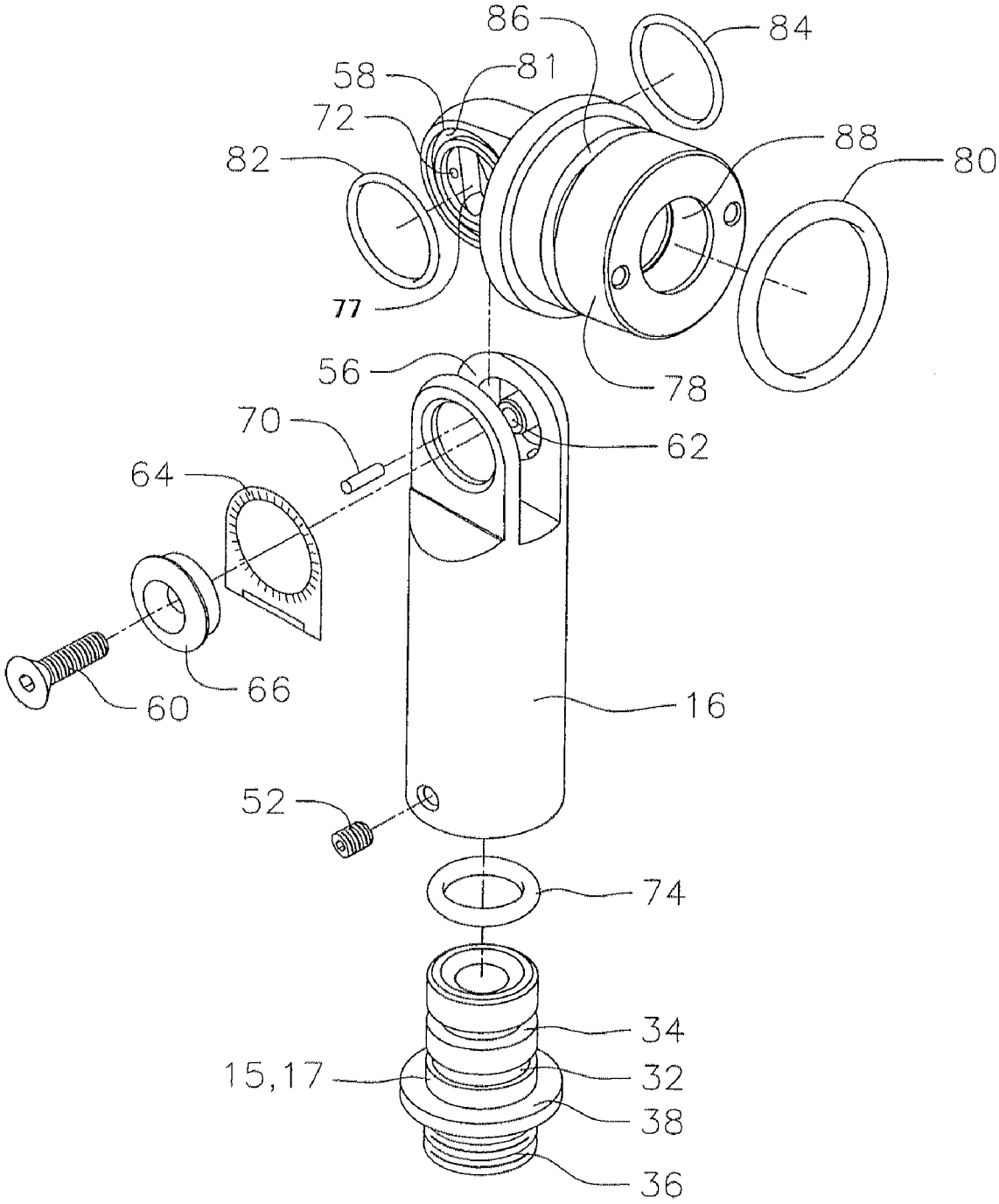
FIG. 5 is an exploded view of the supporting arm and part of the lamp housing in FIG. 4.
Figure 6:
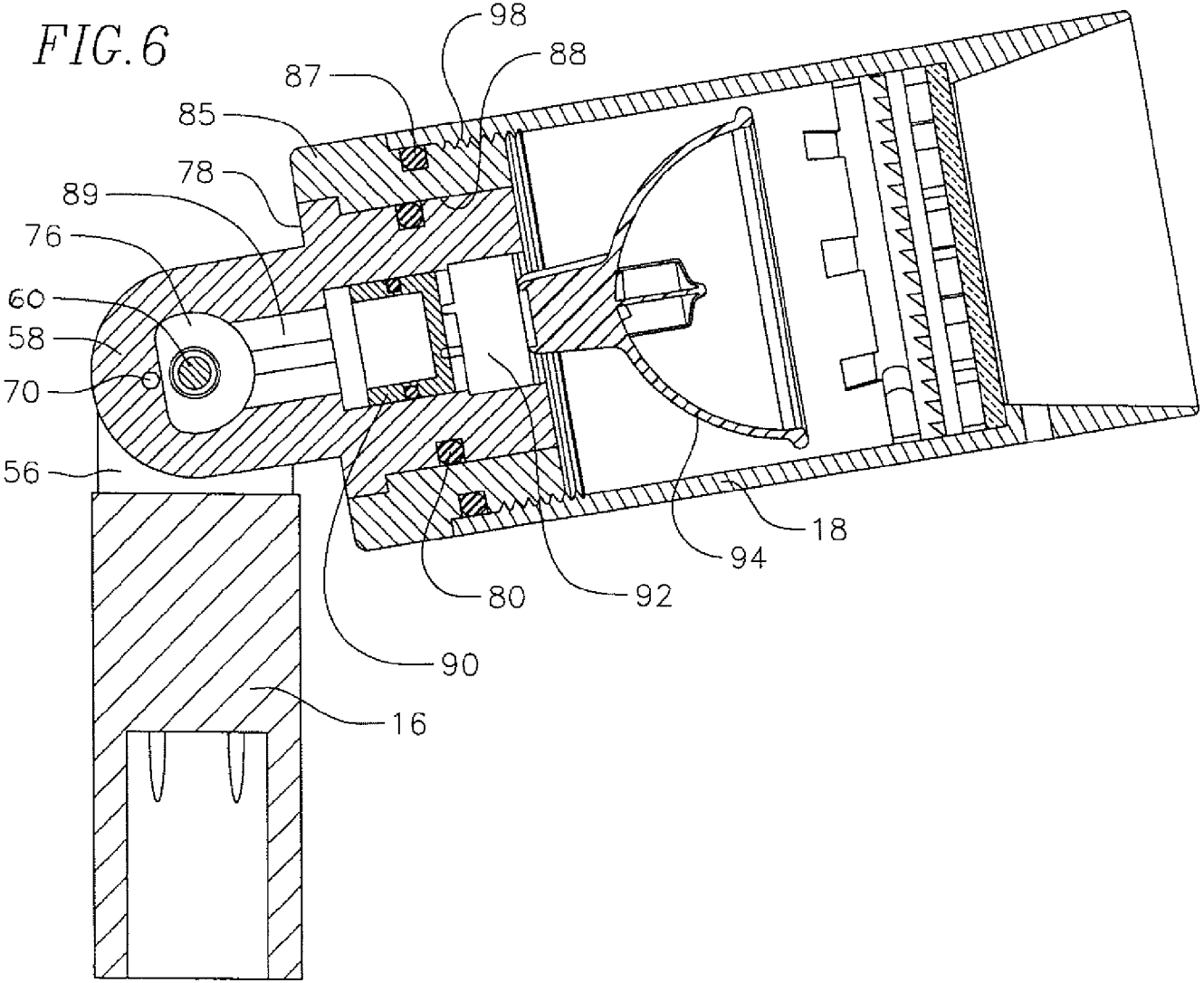
FIG. 6 is a side sectional view of the lamp housing from the same perspective as FIG. 4

As shown in FIGS. 4 and 5, set screw 52 is located at one end of arm 16 and a hinge 54 is located at the other end of arm 16. Hinge 54 comprises a yoke 56 formed at the end of arm 16 and a knuckle 58 formed at the closed end of lamp housing 18. Knuckle 58 fits in yoke 56 and is secured by a screw 60 and a threaded bore 62 formed inside yoke 56. A scale 64 is mounted on the outer surface of arm 16 by means of a clamping ring 66. Clamping ring 66 passes through an opening in arm 16 until it is near the edge of bore 62. As a result, yoke 56 and knuckle 58 remain axially aligned with each other during rotation. Scale 64 has evenly spaced graduations each representing an increment of angular position relative to a reference position, for example, 10 degrees. Lamp housing 18, which has a circular edge in this embodiment, can assume any rotational position represented by arrow 24 (FIG. 1) within a range of 180 degrees. A marker 68 (FIG. 4) on clamping ring 66 designates the rotational position of lamp housing 18 relative to arm 16. To set the rotational position of lamp housing 18, screw 60 is loosened and knuckle 58 is turned until marker 68 has rotated a specified number of graduations. Then screw 60 is tightened to set the position of lamp housing 18. A coupling pin 70 fits into a hole 72 in knuckle 58 and a hole 76 (shown in FIG. 8) on clamping ring 66. As a result, when lamp housing 18 turns, clamping ring 66 also turns to show the displacement of lamp housing 18 in the rotational direction represented by arrow 24. An O-ring 74 is retained in groove 34. In addition to seal formation, O-ring 74 provides some resistance to rotation so human force is required to rotate the nipple (13, 15, or 17) and the part into which it is inserted. A passage 77 passes through knuckle 58. A base in the form of a plug 78 is integrally formed with knuckle 58. Housing 18 is rotatably attached to knuckle 58 by a threaded connection 98 (FIG. 6). Since the lighting fixture is intended to withstand the elements, it is further sealed from moisture by O-ring seals 80, 82, and 84. Seals 82 and 84 are seated in circular retaining grooves 81 at the ends of passage. (One of grooves 81 is visible in FIG. 5.) Seal 80 is seated in an annular retaining groove 86 in plug 78.

As shown in FIG. 6, plug 78 fits in a bore 88 in an end cap 85 where it is secured by a set screw (not shown). End cap 85 has a threaded connection with housing 18 that is protected by an O-ring seal 87. A bore 89 passes through plug 78 from housing 18 to knuckle 58. A lamp socket 90 and contacts 92 of a lamp 94 are disposed in bore 89 in plug 78.

Figure 8:
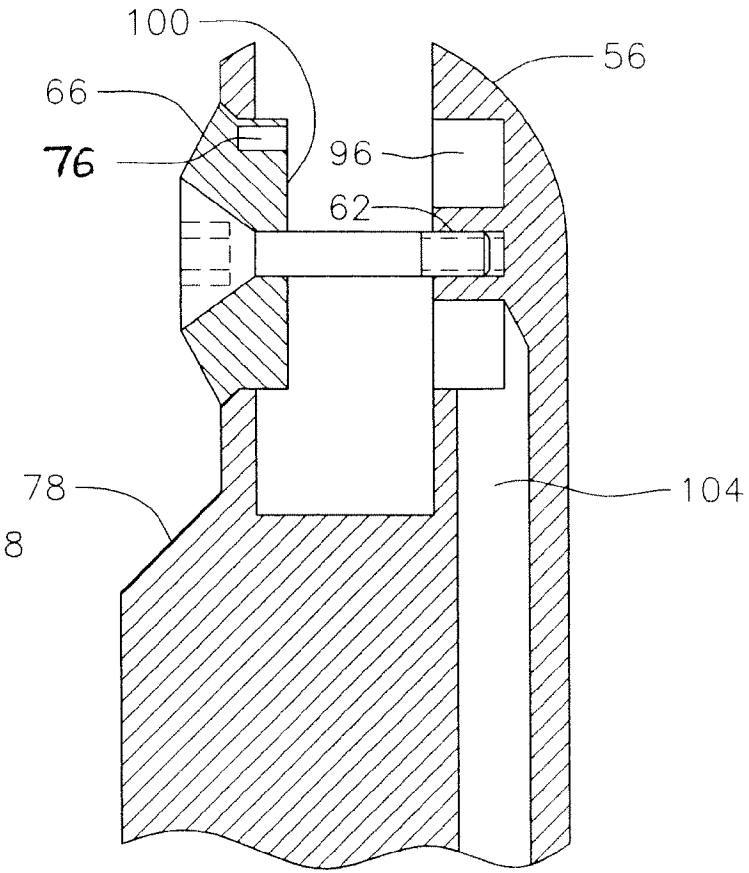
FIG. 8 is a front sectional view of the clamping ring and yoke and taken through plane 8-8 in FIG. 7.
Figure 7:
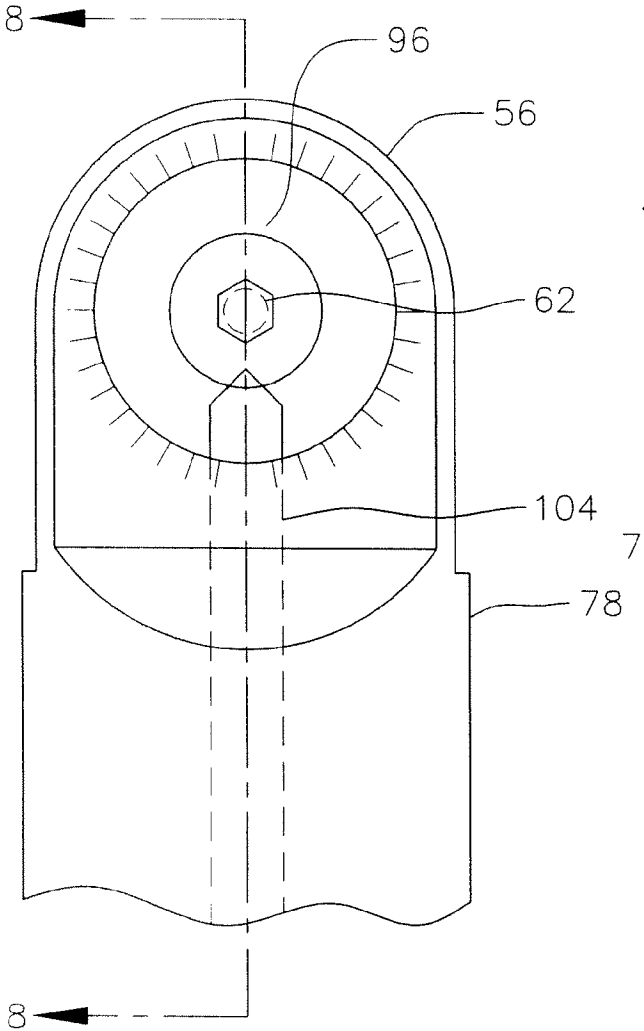
FIG. 7 is a side elevation view of the clamping ring and the yoke formed in the supporting arm of the lighting fixture.

Reference is made to FIGS. 7 and 8 for a further description of yoke 56. An annular channel 96 is formed around bore 62. A longitudinal bore 104 runs through yoke 16 from its end adjacent to arm stem 14 to channel 96. As shown in FIG. 8, clamping ring 66 has an end 100 that extends into the space inside yoke 56. When assembled, end 100 of clamping ring 66 thus centers knuckle 58 relative to yoke 56. Hole 76, previously mentioned in connection with FIG. 5, is located on end 100. Hole 76 receives pin 70 (FIG. 5), thereby coupling clamp 66 and marker 68 (FIG. 4) to rotate with knuckle 58. Electrical power is delivered from the J-box to lamp housing 18 through the following passage: the wires leaving the J-box pass through the hollow interior of arm stem 14 and bore 104 in arm 16 to yoke 56. At yoke 56 the wires enter channel 96 and from there wind around passage 77 into bore 89 and then lamp socket 90. It should be noted that the wires do not bind when they are bent as knuckle 58 rotates in the direction shown by arrow 24 because the wires are channeled through the described passage.

What is claimed is:

1. A lighting fixture comprising:

a fixed mounting plate;

a nipple having opposing proximal and distal ends along a central axis of the nipple, one of the ends providing a threaded fit and the other of the ends providing a slip fit;

a support arm having proximal and distal ends, one of the ends providing a threaded fit and the other of the ends providing a slip fit;

a base supported by the distal end of the support arm so the base is rotatable relative to the support arm about an axis perpendicular to a longitudinal axis of the support arm; and an elongated lamp housing rotatably attached to the base, wherein the proximal end of the support arm is connected to the mounting plate via the nipple, the proximal end of the nipple being inserted into the mounting plate and the distal end of the nipple being inserted into the proximal end of the support arm, the threaded fit of the nipple being in a direction along the longitudinal axis of the support arm, the support arm being rotatable about the longitudinal axis relative to the mounting plate via the slip fit, wherein the base and the distal end of the support arm are rotatably coupled by a hinge comprising a knuckle and a yoke, the yoke has two spaced apart arms and a knuckle receiving slot between the arms, wherein a first cavity lies in the slot and a second cavity lies in one of the arms of the yoke, the first and second cavity for receiving a wire therethrough.

2. The lighting fixture of claim 1, wherein the proximal end of the nipple provides the threaded fit and the distal end of the nipple provides the slip fit.

3. The lighting fixture of claim 1, wherein the support arm comprises axially-aligned first and second arm members and a second nipple connecting the first and second arm members.

4. The lighting fixture of claim 3, wherein the second nipple has a proximal end with a threaded fit and a distal end with a slip fit.

5. The lighting fixture of claim 1, wherein the yoke is provided on the support arm and the knuckle is provided on the base.

6. The lighting fixture of claim 1, wherein the yoke is provided on the base and the knuckle is provided on the support arm.

7. The lighting fixture of claim 1, further comprising:

the first cavity passing axially through the knuckle;

the second cavity extending around the yoke in communication with the first cavity;

a first wire receiving passage extending longitudinally through the knuckle from the yoke, the first passage opening into the first cavity;

a second wire receiving passage extending longitudinally through the yoke from the knuckle, the second passage opening into the second cavity; and the cavities being adapted to accommodate the wire threaded through the passages as the knuckle rotates relative to the yoke.

8. The lighting fixture of claim 5, further comprising:

the first cavity passing axially through the knuckle;

the second cavity extending around the yoke in communication with the first cavity;

a first wire receiving passage extending longitudinally through the knuckle from the yoke to the base to which the knuckle is fixed, the first passage opening into the first cavity;

a second wire receiving passage extending longitudinally through the yoke from the knuckle to the support arm to which the yoke is fixed, the second passage opening into the second cavity; and the cavities being adapted to accommodate the wire threaded through the passages as the knuckle rotates relative to the yoke.

9. The lighting fixture of claim 6, additionally comprising:

the first cavity passing axially through the knuckle;

the second cavity extending around the yoke in communication with the first cavity;

a first wire receiving passage extending longitudinally through the knuckle from the yoke to the support arm to which the knuckle is fixed, the first passage opening into the first cavity;

a second wire receiving passage extending longitudinally through the yoke from the knuckle to the base to which the yoke is fixed, the second passage opening into the second cavity; and the cavities being adapted to accommodate the wire threaded through the passages as the knuckle rotates relative to the yoke.

10. The lighting fixture of claim 7, wherein the first passage is centered in the knuckle.

11. The lighting fixture of claim 7, wherein the second passage is off centered in the yoke.

12. A lighting fixture comprising:

a fixed mounting plate;

a nipple having proximal and distal ends, one of the ends providing a threaded fit and the other of the ends providing a slip fit;

a support arm having proximal and distal ends;

a base supported by the distal end of the support arm so the base is rotatable relative to the support arm about an axis perpendicular to a longitudinal axis of the support arm; and an elongated lamp housing rotatably attached to the base, wherein the proximal end of the support arm is connected to the mounting plate via the nipple, the proximal end of the nipple being inserted into the mounting plate and the distal end of the nipple being inserted into the proximal end of the support arm, the threaded fit of the nipple being in a direction along the longitudinal axis of the support arm, the support arm being rotatable about the longitudinal axis relative to the mounting plate via the slip fit, and wherein the base and the distal end of the support arm are rotatably coupled by a hinge comprising a knuckle and a yoke;

a first cavity passing axially through the knuckle;

a second cavity extending around the yoke in communication with the first cavity;

a first wire receiving passage extending longitudinally through the knuckle from the yoke, the first passage opening into the first cavity;

a second wire receiving passage extending longitudinally through the yoke from the knuckle, the second passage opening into the second cavity; and the cavities being adapted to accommodate a wire threaded through the passages as the knuckle rotates relative to the yoke, wherein the yoke has two spaced apart arms and a knuckle receiving slot between the arms and wherein the first cavity lies in the slot, wherein the second cavity lies in one of the arms of the yoke, and wherein the second cavity is a circular channel on one arm of the yoke and the first cavity is a semi-circular opening passing completely through the knuckle.

* * * * *